US011428504B2

(12) United States Patent
Ward et al.

(10) Patent No.: US 11,428,504 B2
(45) Date of Patent: Aug. 30, 2022

(54) BODY ARMOR SYSTEM

(71) Applicant: THE JAAW GROUP, LLC, Sandy, UT (US)

(72) Inventors: Joel Anderson Ward, Sandy, UT (US); Adrian Sample Ward, Sandy, UT (US)

(73) Assignee: The JAAW Group, LLC, Cottonwood Heights, UT (US)

( * ) Notice: Subject to any disclaimer, the term of this patent is extended or adjusted under 35 U.S.C. 154(b) by 22 days.

(21) Appl. No.: 16/387,289

(22) Filed: Apr. 17, 2019

(65) Prior Publication Data

US 2020/0333111 A1 Oct. 22, 2020

(51) Int. Cl.

| | |
|---|---|
| ***F41H 1/02*** | (2006.01) |
| ***A41D 13/00*** | (2006.01) |
| ***F41H 5/013*** | (2006.01) |

(52) U.S. Cl.

CPC ..... *F41H 1/02* (2013.01); *A41D 13/0002* (2013.01); *F41H 5/013* (2013.01); *A41D 2400/46* (2013.01)

(58) Field of Classification Search

CPC ..... F41H 1/02; F41H 5/013; A41D 13/0002; A41D 2400/46; A45F 2003/166; A45F 3/06; A45F 3/04; A45C 2003/005; A45C 3/004

See application file for complete search history.

(56) References Cited

U.S. PATENT DOCUMENTS

| | | | | |
|---|---|---|---|---|
| 5,829,653 | A * | 11/1998 | Kaiser | F41C 33/046 224/577 |
| 6,012,162 | A * | 1/2000 | Bullat | A41D 13/018 2/2.5 |
| 6,497,348 | B2 | 12/2002 | Forsman et al. | |
| 8,820,596 | B1 * | 9/2014 | Bergquist | A45C 3/004 224/153 |
| 9,021,612 | B1 | 5/2015 | O'Neal | |
| 9,874,425 | B2 | 1/2018 | O'Neal | |
| 2006/0180487 | A1 * | 8/2006 | Chan | B25H 3/023 206/373 |
| 2012/0180205 | A1 * | 7/2012 | Herring | F41H 1/02 2/463 |
| 2012/0180631 | A1 * | 7/2012 | Sporn | F41H 1/02 89/36.02 |

(Continued)

OTHER PUBLICATIONS

Adaptive Plate Insert, p. 1, https://www.ar500armor.com/plate-pocket-insert-9720.html.

(Continued)

*Primary Examiner* — Katherine M Moran
*Assistant Examiner* — Erick I Lopez
(74) *Attorney, Agent, or Firm* — Paul C. Oestreich; Eminent IP, P.C.

(57) ABSTRACT

A body armor system includes a pouch and an armor plate and hydration bladder disposed within the pouch. The shape of the hydration bladder corresponds to the shape of the armor plate and is dimensioned such that the hydration bladder is hidden behind the armor plate during use. The pouch includes a front pouch in which the armor plate is disposed and a rear pouch in which the hydration bladder is disposed. The hydration bladder can be filled with fluid, which is configured to absorb and disperse ballistic energy transferred from the armor plate when struck.

17 Claims, 8 Drawing Sheets

(56) References Cited

U.S. PATENT DOCUMENTS

| | | | | |
|---|---|---|---|---|
| 2016/0169632 | A1* | 6/2016 | Holtz | F41H 5/0428 89/36.02 |
| 2016/0273886 | A1* | 9/2016 | O'Neal | F41H 1/02 |
| 2017/0231371 | A1* | 8/2017 | Li | A41D 13/0058 62/259.3 |

OTHER PUBLICATIONS

Adaptive Plate Insert, p. 2, https://www.ar500armor.com/plate-pocket-insert-9720.html.

Adaptive Plate Insert, p. 3, https://www.ar500armor.com/plate-pocket-insert-9720.html.

AR500 Armor How to Wear Speed Plates with your Adaptive Plate Insert System, Screen Shots, youtube.com/watch?v=xxjZbRTv6UU.

PAXCON by LINE-X—Blast Mitigation and Spall Protective Coatings retrieved from https://paxcon.co.uk on May 12, 2020; 3 pages.

* cited by examiner

BODY ARMOR SYSTEM

CROSS-REFERENCE TO RELATED APPLICATIONS

N/A

BACKGROUND OF THE INVENTION

1. The Field of the Invention

The present invention relates generally to body armor systems, methods, and apparatus. In particular, the present invention relates to modular, improved body armor systems for use in military, law enforcement, and other security settings.

2. Background and Relevant Art

Existing body armor systems typically include a body armor plate, and/or a trauma pad secured within a plate carrier or worn in conjunction with a vest. Current plates and trauma pads are designed to prevent a bullet from entering the body of the wearer. However, energy from the bullet may still transfer through the plate or trauma pad and into the body, causing serious injury or death, even if the plate or trauma pad successfully prevents the bullet from passing therethrough.

Armor plates and other ballistic armor components used in the field typically meet minimum National Institute of Justice (NIT) performance standards. NIT standards include a number of levels of required protection, ranging from Level I and Level II armor that protects against 9 mm, 0.45 ACP, and similar small cartridge ballistics, to Level IV armor that protects against large cartridge ballistics, such as 30.06 M2AP cartridges and the like. However, armor plates and trauma pads, including bullet-proof vests and armor plates currently used or known in the art, which meet NIJ standards, are still often incapable of effectively absorbing or dispersing ballistic energy away from the body of the wearer upon impact to prevent serious injury, even if the ballistic is prevented from penetrating the armor.

In addition, in certain settings, such as military or law enforcement settings, a soldier or officer is required to carry a large amount of equipment. Such equipment may include ammunition magazines, guns, food and hydration supplies, radios, and so forth. The weight of armor plates and pads, which can be quite heavy, is carried in addition to the weight from such equipment used in the field. It is not uncommon for a soldier to carry eighty pounds or more during training or battlefield operations.

This weight is often distributed unevenly from front to back of the soldier. For example, most equipment is carried on the back of the soldier to reduce the amount of equipment that may get in the way of the soldier's arms or hands when operating firearms or performing other active maneuvers in the front of their body. The unevenly distributed weight can put excess strain on the back, shoulders, and other muscle groups, resulting in fatigue and injuries.

Typically, at least one piece of equipment, which is carried on the front of a soldier's vest, is an armor plate. Currently, soldiers are taught to "square-up" when confronting an enemy. This means the soldier faces the enemy head-on to position the front armor plate between the enemy and the soldier. Squaring-up also provides increased visibility, movement, and aiming ability to the soldier. As such, it is important to have sufficient protection disposed on the front of the body to protect soldiers when squaring-up to the enemy.

Alternative body armor systems that may improve ballistic energy dispersion and absorption upon impact typically require additional equipment and/or alterations. These additional pieces of equipment and/or alterations to existing equipment may not be compatible with military plate vests typically worn by soldiers in the field. The extra equipment may also add to the weight carried by the soldier or take up too much space within or on a soldier's vest. As such, this extra equipment may add to the total silhouette of the wearer, which is disadvantageous during battlefield or other law enforcement and security operations.

Accordingly, there are a number of disadvantages in the art that can be addressed.

BRIEF SUMMARY OF THE INVENTION

Embodiments of the present disclosure relate generally to body armor systems, methods, and apparatus. In particular, the present disclosure relates to modular, improved body armor systems for use in military, law enforcement, or other security settings. In particular, in one embodiment of the present disclosure, a body armor system includes a pouch, and armor plate disposed within the pouch, and a hydration bladder disposed within the pouch behind the armor plate. In one embodiment of the body armor system, the shape of the hydration bladder corresponds to the shape of the armor plate and is dimensioned so as to be hidden behind the armor plate during use.

In one embodiment of the present disclosure, a body armor kit includes a pouch and a hydration bladder. The pouch is configured to receive the hydration bladder within the pouch during use. In one embodiment, the kit also includes an armor plate. In one embodiment the shape of the hydration bladder corresponds to the shape of a swimmer armor plate. In one embodiment the shape of the hydration bladder corresponds to the shape of a square armor plate. In one embodiment the shape of the hydration bladder corresponds to the shape of a shooter armor plate.

In one embodiment of the present disclosure, a method of assembling a body armor system includes providing a body armor system. The body armor system includes a pouch, a hydration bladder, and an armor plate. The next step in the method includes opening the pouch. The next step includes inserting the hydration bladder into the pouch. The next step includes closing the pouch. The next step includes folding the pouch. The next step includes inserting the armor system into a front portion of a plate carrier through a bottom opening in the front portion of the plate carrier.

Additional features and advantages of exemplary embodiments of the invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Embodiments of the present disclosure relate generally to body armor systems, methods, and apparatus. In particular, the present disclosure relates to modular, improved body armor systems for use in military, law enforcement, and other security settings. Embodiments of the present disclosure address a number of disadvantages in the art, as discussed above.

For example, embodiments of body armor systems disclosed herein effectively absorb and disperse ballistic energy away from the body when hit. The improved absorption and dispersion of ballistic energy reduces the likelihood of serious injury and death from bullets hitting the body armor system. Accordingly, embodiments of body armor systems disclosed herein meet at least NIJ level I-IV body armor standards described above.

In addition, embodiments of body armor systems disclosed herein reduce the total silhouette of soldiers and do not significantly add to the total weight carried by soldiers in the field. Also, embodiments of body armor systems disclosed herein improve the weight distribution of equipment carried by soldiers.

In addition, embodiments of body armor systems disclosed herein provide hydration systems that can be carried using clothing or equipment that does not separate from the wearer. For example, in at least one embodiment, rather than carrying hydration fluids in a backpack, which may be taken off periodically or left behind, the armor systems of the present disclosure include hydration bladders that are carried in armor plate carriers, which are not typically separated from the wearer. In this way, the wearer will not be separated from their hydration fluid source during use of the armor system.

Furthermore, embodiments of body armor systems disclosed herein are compatible with current body armor plates and plate carriers currently used by the military and other law enforcement agencies. The body armor systems of the present disclosure can be added, removed, and used in conjunction with existing systems without the need to alter existing systems and equipment. Accordingly, embodiments of body armor systems disclosed herein can be used with NIJ compliant systems and plates of any size and shape.

Figure 1:
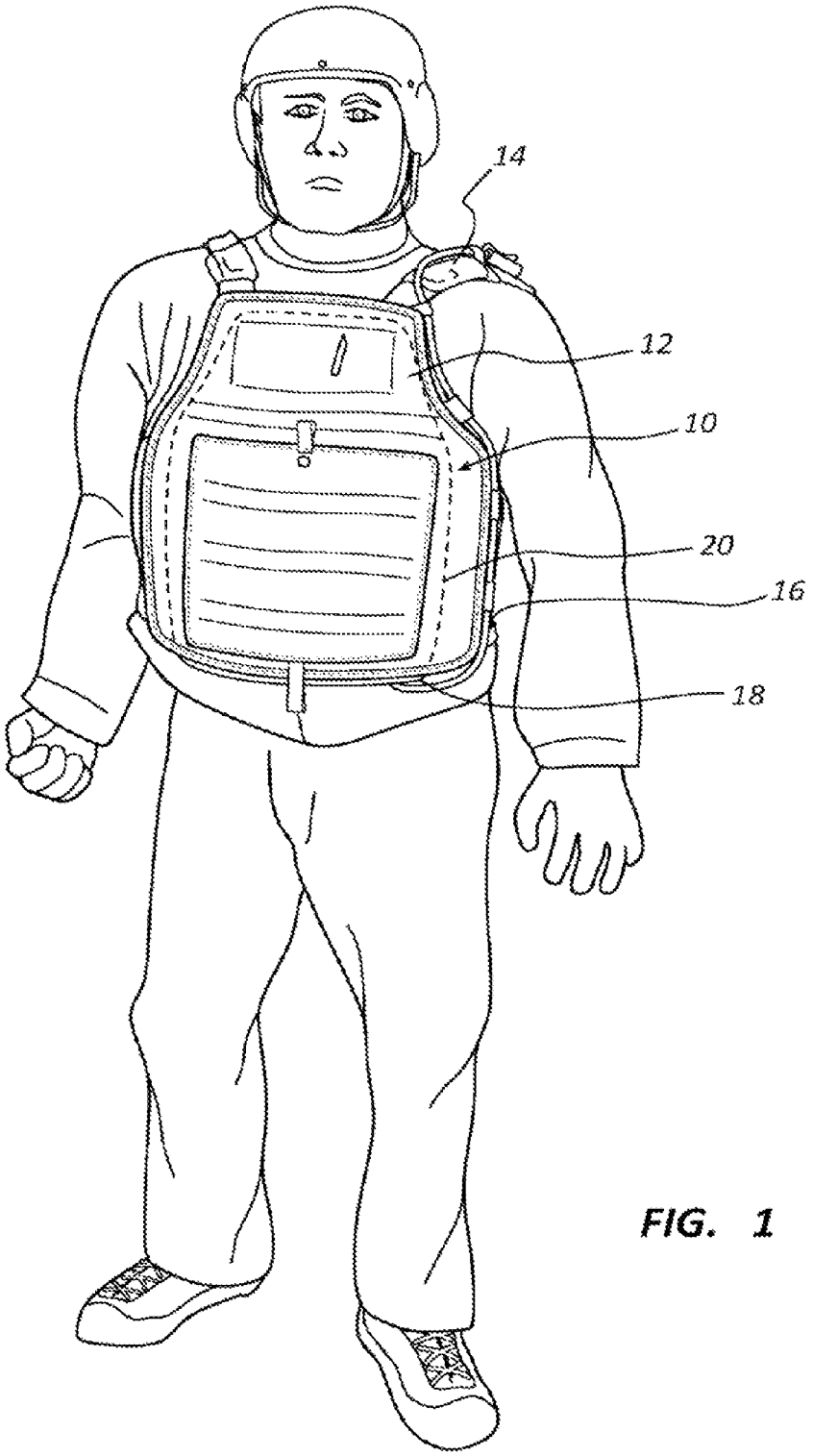
FIG. 1 illustrates an embodiment of a body armor system worn by a soldier, including a plate carrier vest, according to the present disclosure.

Turning now to the figures, FIG. 1 illustrates a typical plate carrier vest 10 worn by a soldier during military operations. The plate carrier 10 generally includes a front portion 12 secured to the body via shoulder straps 14 and side portions 16. Various pieces of equipment, such as magazines, firearms, radios, or other equipment can be secured to the front portion 12, shoulder straps 14, and/or side portions 16 during use.

In addition, the plate carrier 10 includes a bottom opening 18 at the bottom of the front portion 12 that may be selectively opened and closed. The bottom opening 18 provides access to an inner compartment of the front portion 12 of the plate carrier 10 into which armor plates and/or trauma pads are inserted. Once an armor plate and/or trauma pad is inserted into the inner compartment of the front portion 12, the bottom opening 18 may be closed to secure the armor plate and/or trauma pad therein.

In at least one embodiment, a body armor system 20 of the present disclosure (indicated by the dotted lines in FIG. 1) is disposed within the inner compartment of the front portion 12. As noted above, the body armor system 20 can be inserted into plate carriers 10 commonly used by the military and other law enforcement agencies through the existing bottom opening 18 without altering the plate carrier 10 or requiring any additional equipment or customized plate carrier.

Figure 2:
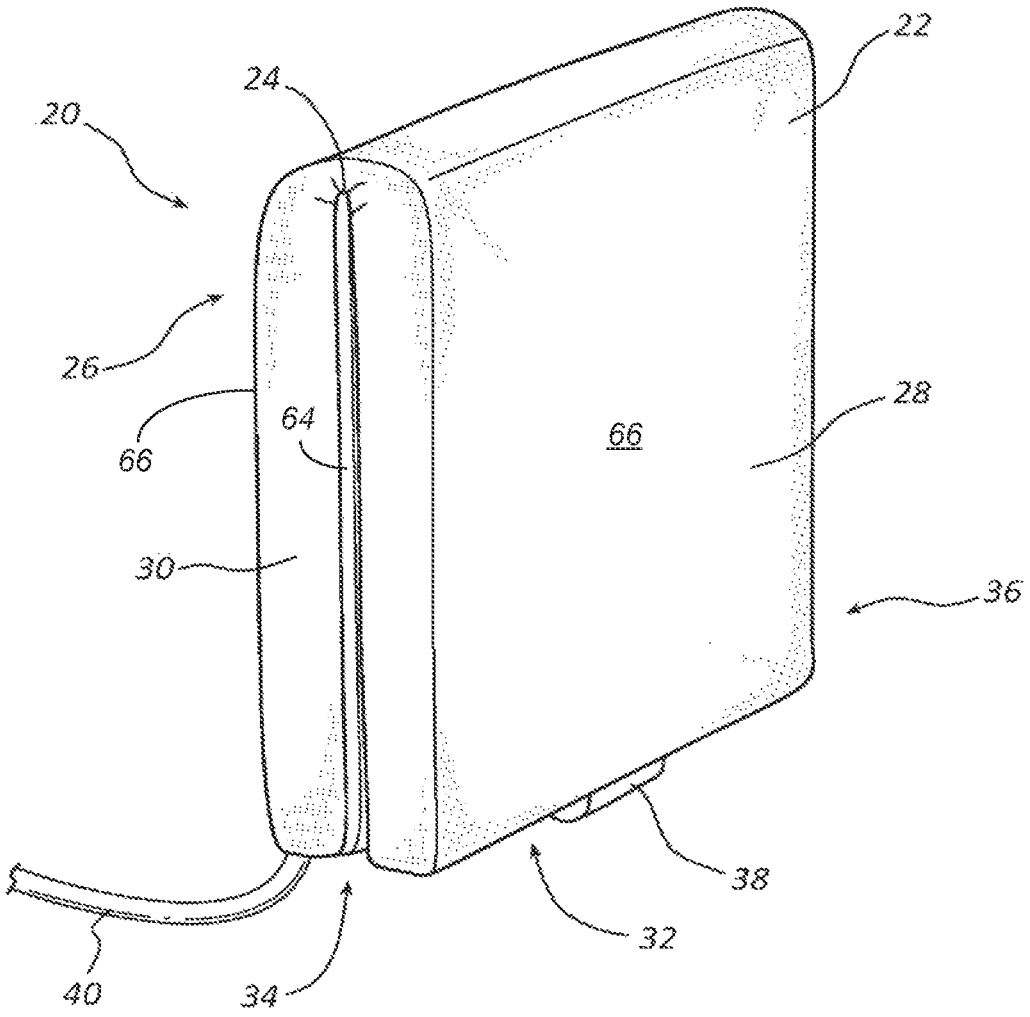
FIG. 2 illustrates an embodiment of a body armor system, including a pouch assembly in a closed configuration and a hydration hose extending from the pouch, according to the present disclosure.

FIG. 2 illustrates an embodiment of a body armor system 20, including a pouch assembly 22 in a closed configuration. In at least one embodiment, the pouch assembly 22 is made of flexible material that can be folded over to form a crease 24 at the top end 26 of the pouch assembly 22. When the pouch assembly 22 is folded in a closed configuration as shown in FIG. 2, the pouch assembly 22 forms a front pouch 28 and a rear pouch 30. The front and rear pouches 28, 30 define internal compartments separated by the crease 24. As shown in FIG. 2, the pouch assembly 22 in the closed configuration includes an inner layer 64 folded against itself and an outer layer 66.

The pouch assembly 22 may be comprised of durable, flexible material that allows a user to fold the pouch assembly 22 into a closed configuration as shown in FIG. 2. For example, in at least one embodiment, the pouch assembly 22 comprises 1200 Denier nylon fabric. Other embodiments of the pouch assembly 22 may include other woven fabric materials, either natural or synthetic, including but not limited to nylon, polyester, silk, cotton, wool or other fabrics or combinations thereof. Additionally, or alternatively, one or more embodiments of the pouch assembly 22 may comprise other materials such as polymers including rubbers and plastics, or synthetic fibers such as Kevlar, or other materials generally known in the art or combinations thereof. Preferably, the pouch assembly 22 comprises one or more materials that are durable, light-weight, flexible, and weather resistant.

In addition, in at least one embodiment, the closed pouch assembly 22 forms a front bottom opening 32 providing access to the internal compartment of the front pouch 28 and a rear bottom opening 34 providing access to the internal compartment of the rear pouch 30. Each bottom opening 32, 34 is disposed at the bottom end 36 of the pouch assembly 22 during use.

In addition, the pouch assembly 22 includes a closing mechanism 38 or other closing means for closing the bottom openings 32, 34 of the front and rear pouches 28, 30. In one or more other embodiments, the pouch assembly 22 may include a variety of different mechanisms to close the bottom openings 32, 34. For example, in at least one embodiment, the closing mechanism 38 may include a Velcro strap mechanism. In at least one embodiment, the closing mechanism 38 may include buttons, zippers, clips, other well-known securement mechanisms known in the art, or combinations thereof.

In at least one embodiment, the closing mechanism 38 may completely close the bottom openings 32, 34. In at least one embodiment, the closing mechanism 38 may only partially close the bottom openings 32, 34. In any case, the front and rear bottom openings 32, 34 may be closed via the closing mechanism 38 to prevent components disposed within the front and rear pouches 28, 30 of the pouch assembly 22 from falling out during use. In addition, in at least one embodiment, the rear bottom opening 34 provides access to a hose 40 to enter the internal compartment of the rear pouch 30 during use, even if the rear bottom opening 34 is closed.

In at least one embodiment, the hose 40 may be positioned such that it exits the rear pouch 30 through the rear bottom opening 34 and then exits the bottom opening 18 in the front portion 12 of the plate carrier 10, as shown in FIG. 1. More details regarding the hose 40 and position thereof will be given hereafter with reference to FIGS. 4 and 5. In at least one embodiment, the pouch assembly is separate from the plate carrier 10. In at least one embodiment, the pouch assembly 22 is integrally formed with the plate carrier 10 to form front and rear pouches 28, 30 within the front portion 12 of the plate carrier 10.

Figure 3:
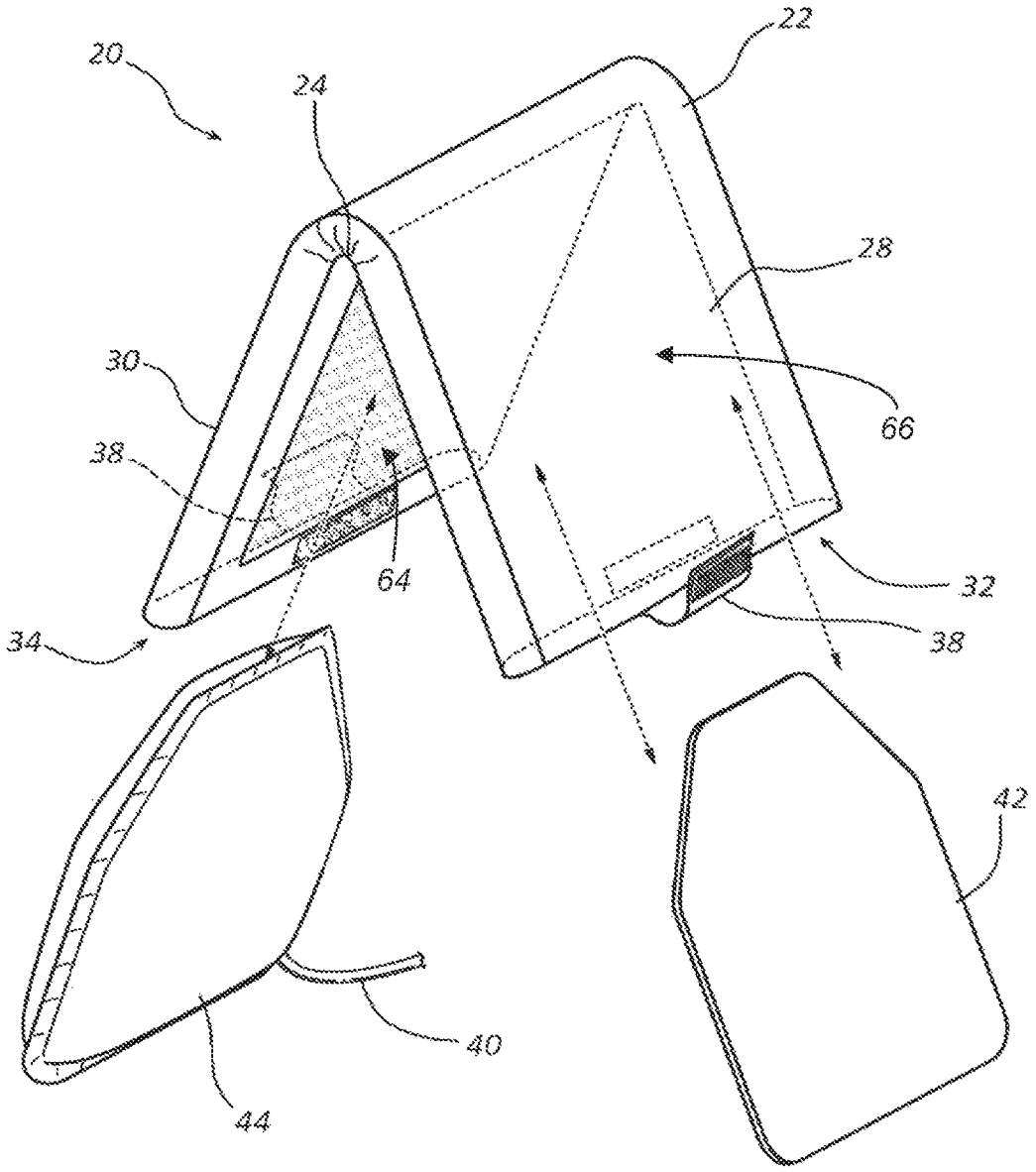
FIG. 3 illustrates an exploded view of an embodiment of a body armor system, including a pouch assembly, armor plate, and hydration bladder, according to the present disclosure.

FIG. 3 illustrates an exploded view of an embodiment of a body armor system 20, including a pouch assembly 22, armor plate 42, and hydration bladder 44. The pouch assembly 22 is shown in a slightly open configuration so that the front pouch 28 and rear pouch 30 are not folded onto one another with an inner layer 64 not folded against itself and an outer layer 66. The front and rear bottom openings 32, 34 of the front and rear pouches 28, 30, respectively, are also shown in an open configuration. The dotted arrows indicate that the armor plate 42 and hydration bladder 44 may be selectively inserted and removed from inner compartments of the front and rear pouches 28, 30.

For example, in at least one embodiment, the armor plate 42 may be inserted into inner compartment of the front pouch 28 and secured therein via the closing mechanism 38 extending over the front bottom opening 32. In at least one embodiment, the armor plate 42 include a standard, NIJ compliant plate commonly used in the field. The size, thickness, and material of the armor plate 42 may vary depending on the needs of a particular operation or preference of the soldier. However, in any case, the pouch assembly 22, including the front pouch 28, is dimensioned to accommodate current armor plates 42 known in the art.

Figure 9A:
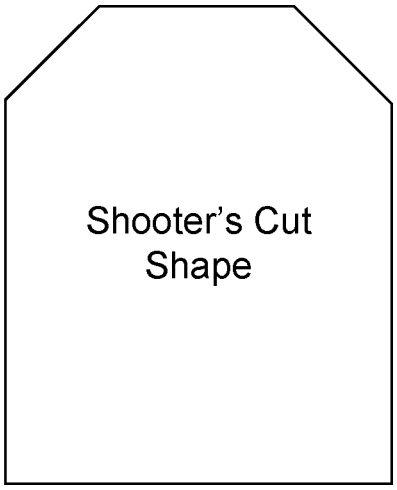
FIG. 9A-9C illustrate advanced shooter's cut, swimmer's and square armor plate shapes, respectively.
Figure 9B:
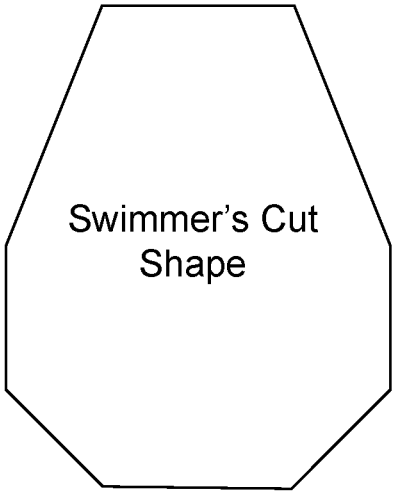
Figure 9C:
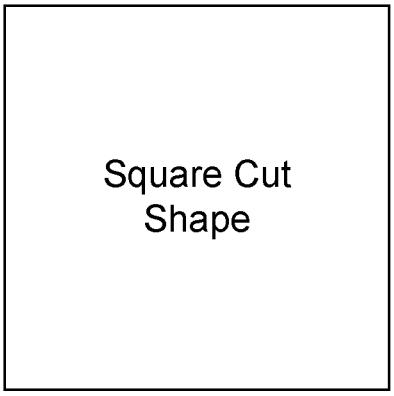

In addition, the shape of the armor plate 42 may vary. For example, in the illustrated embodiment of FIG. 3, the armor plate 42 is an advanced shooter's cut plate used for specific types of operations in the battlefield. Such an advanced shooter's cut plate may include a generally rectangular shape with the upper corners thereof tapered. Other common armor plates include swimmer plates and square plates. Other typical armor plates, which include other shapes, sizes, and configurations, may be used and fitted within the inner compartment of the front pouch 28. For example, and not by way of limitation, FIGS. 9A-9C illustrate advanced shooter's cut, swimmer and square armor plate shapes, respectively. Embodiments of armor systems described herein may be customized and varied depending on the need of the wearer so that the system is able to accommodate any type of armor plate currently known or used in the art.

These various types of armor plates and shapes thereof are those which are commonly used by military and law enforcement personnel so that adopting the body armor systems described herein does not require different or customized armor plates 42. Rather, the body armor systems 20 described herein are compatible with existing armor plates 42, plate carriers 10 (as shown in FIG. 1), and other body armor components currently used in the field.

The hydration bladder 44 can be removably inserted into the inner compartment of the rear pouch 30 through the rear bottom opening 34 and secured therein via the closing mechanism 38. In at least one embodiment, the hydration bladder 44 may be at least partially filled with water or other hydration liquids such as electrolyte-rich fluids or other energy drink fluids. As noted above, the hydration bladder 44 may included a hose 40 extending from the bottom of the hydration bladder 44. In at least one embodiment, the hose 40 is routed out the rear bottom opening 34 of the rear pouch 30, then out the bottom opening 18 in the plate carrier 10, and then routed up towards the mouth of the wearer and connected to an upper portion of the plate carrier 10 or shoulder straps 14, as shown in FIG. 1.

The hose 40 may comprise flexible tubing that enables transfer of the fluid residing inside the hydration bladder 44 to the mouth of the soldier or other wearer. Thus, even when the hydration bladder 44 is secured within the rear pouch 30 of the pouch assembly 22, the hose 40 may exit the pouch assembly 22 for use as a means of providing hydration to the soldier wearing the armor plate system 20.

Also, as seen in FIG. 3, in at least one embodiment, the shape of the hydration bladder 44 matches that of the armor plate 42 and is dimensioned such that the hydration bladder 44, which is disposed behind the armor plate 42 in the rear pouch 30 when worn properly, is hidden behind the armor plate 42. Accordingly, the area taken up by the hydration bladder 44 is less than or equal to the area taken up by the armor plate 42 when disposed within the front portion 12 of the plate carrier 10 (as shown in FIG. 1). As such, in at least one embodiment, no portion of the hydration bladder 44 extends beyond the outer perimeter edges of the armor plate 42 when worn. In at least one embodiment, the hydration bladder 44 does not correspond in shape to the armor plate 42 but is still smaller so that no portion of the hydration bladder 44 extends beyond the armor plate 42. In this way, any type of hydration bladder 44 already sold in the market or used in the art, which is smaller than the armor plate 42, may be used in the armor systems 20 described herein.

In addition, in at least one embodiment, the hydration bladder 44 comprises flexible material that collapses when emptied and flexes outward to increase in interior volume of the hydration bladder 44 when filled. Also, the flexible material of the hydration bladder 44 may also bend and form the hydration bladder 44 to the contours of the front and or rear torso of a soldier wearing the armor system 20.

Figure 4:
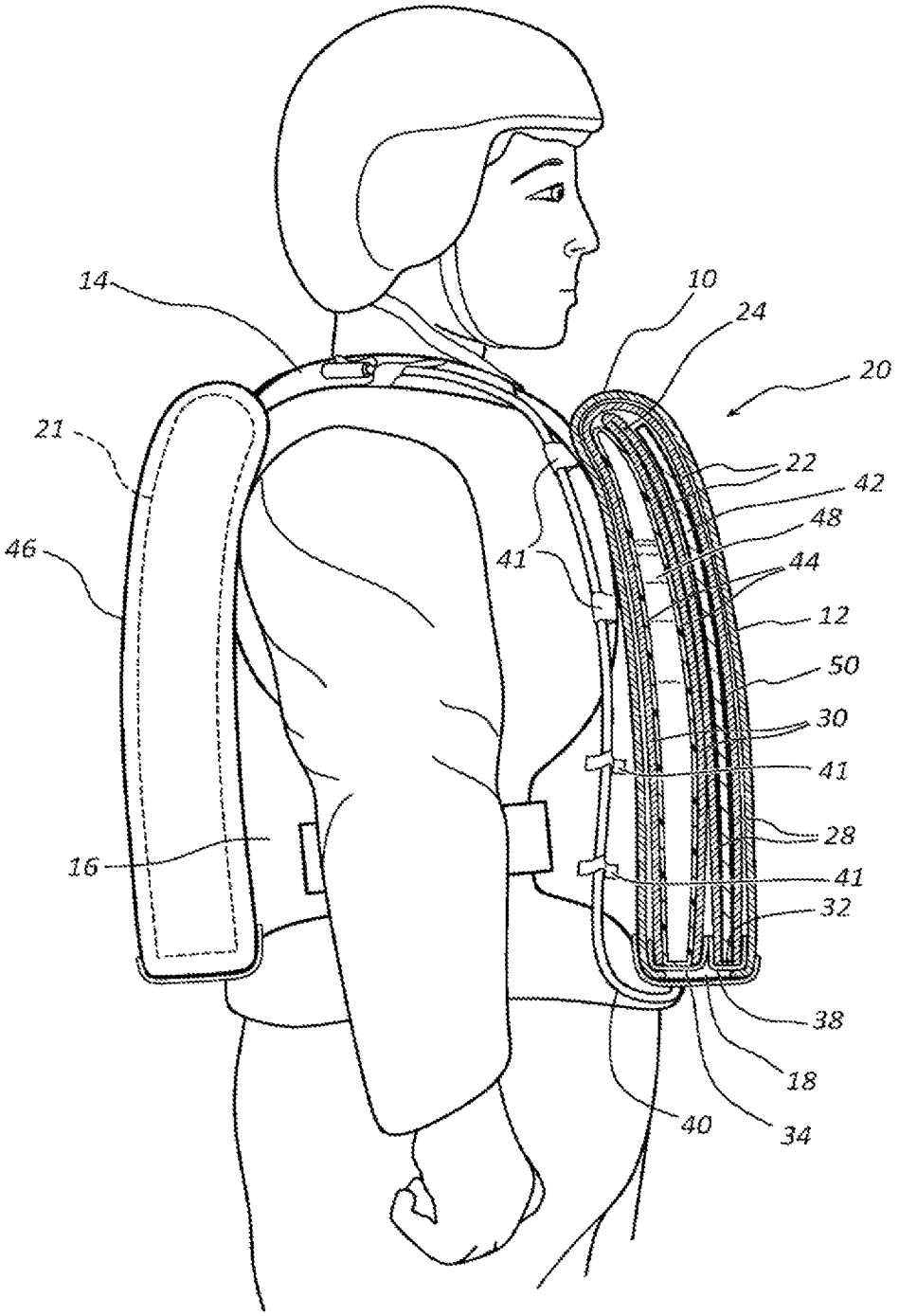
FIG. 4 illustrates a side cross-sectional view of an embodiment of a body armor system worn by a soldier, including a plate carrier vest, pouch assembly, armor plate, and hydration bladder, according to the present disclosure.

Along these lines, FIG. 4 illustrates a side view of an embodiment of a body armor system 20 worn by a soldier. The armor system 20 is shown in a cross-sectional cut-away view to illustrate the relative position of various components thereof. As noted above, in at least one embodiment, the armor system 20 may be inserted into the front portion 12 of a plate carrier 10, which may also include shoulder straps 14, side portions 16, and a rear portion 46. In at least one embodiment, the armor system 20 includes a pouch assembly 22 including a front pouch 28 and rear pouch 30 selectively closed at respective bottoms 32, 34 by closing mechanisms 38, an armor plate 42 disposed within the front pouch 28, and a hydration bladder 44 disposed within the rear pouch 30.

Advantageously, the armor system 20 may be inserted through the bottom opening 18 of the plate carrier 10 to avoid interfering with the soldier's chin/head or other equipment typically connected to an upper portion of the plate carrier 10. For example, soldier's typically attach pistols, magazines, radios, or other equipment to the top of the front portion 12 of the plate carrier 10. In at least one embodiment, the armor system 20 is configured to be easily removed from the bottom opening 18 without needing to turn the head or chin up or sideways to accommodate the armor system 20 as it is inserted into the plate carrier 10.

Additionally, in at least one embodiment, the front pouch 30 may include an absorptive material, such as PAXCON or other spall-absorbing material, sprayed or otherwise applied to the front surface 50 thereof. During a ballistic attack, many injuries occur due to ballistic fragmentation or spalling. The spall-absorbing layer applied to the front surface 50 of the front pouch 28 encapsulates the ballistic fragments, which remain trapped in the spall-absorbing material. This additional spall-absorbing material may be added to the front pouch 28 whether the armor plate 42 disposed within the front pouch 28 includes similar spall-absorbing material layers or not. Additionally, in at least one embodiment, the PAXCON or other spall-absorbing material can also be applied to the rear pouch 30 of the pouch assembly 22.

Furthermore, in at least one embodiment, the armor system 20 includes one or more trauma pads, such as polystyrene foam pads, Kevlar pads, or other common trauma pads known and used in the art. In one or more embodiments, the one or more additional trauma pads may be placed inside, outside, or between either pouch 28, 30 of the pouch assembly 22, within the front portion 12 of the plate carrier 10, or outside the plate carrier 10 between the plate carrier 10 and the torso of the soldier.

As noted above and shown in FIG. 4, the hydration bladder 44 includes a hose 40 that extends from a bottom portion thereof, out the rear bottom opening 34 of the rear pouch 30, and out through the bottom opening 18 of the front portion 12 of the plate carrier 10. In at least one embodiment, as noted above, the hose 40 may connect to the plate carrier 10 at or near the mouth of the soldier, for example on the shoulder strap 14. In such an embodiment, the plate carrier 10 may include one or more straps 41 or other attachment means for securing the hose 40 to the plate carrier 10 vertically up to the shoulder strap 14. The straps 41 may include any number of securement mechanisms known in the art, such as VELCRO, buttons, and the like.

The hydration bladder 44 bends and flexes to conform to the contours of the soldier's torso when worn properly. In addition, the hydration bladder 44 forms an inner volume 48 that may be partially or completely filled with hydration fluid. The fluid thus disposed between the armor plate 42 and torso of the soldier provides a number of advantages.

For example, fluid disposed within the inner volume 48 of the hydration bladder 44 advantageously absorbs ballistic energy from ballistic strikes to the armor plate 42. At least part of the ballistic energy transfers through the armor plate 42, through the pouch assembly 22 materials, and into the fluid disposed the inner volume 48 of the hydration bladder 44. Fluid, such as water, is effective in absorbing and dispersing the ballistic energy so that the ballistic energy does not pass entirely into the body of the soldier or other wearer. Thus, in at least one embodiment, the armor plate 42 prevents the ballistic from passing through to the hydration bladder 44 and the hydration bladder 44 reduces the amount of ballistic energy entering the body. This added protection on the front of the soldier is especially important when squaring-up to the enemy, as noted above.

In at least one embodiment, the materials of the hydration bladder 44 discussed above are strong enough to prevent failure of the hydration bladder 44 upon transfer of ballistic energy to the fluid from a ballistic impact to the adjacent armor plate 42. Also, as noted above, in one or more embodiments, the shape of the hydration bladder 44 can match the shape of the armor plate 42, no matter the shape or type of plate used, and is dimensioned such that it is hidden behind the armor plate 42 during proper use. As such, the material of the hydration bladder 44 is not exposed to ballistic projectiles or spall during an attack so that the hydration bladder 44 is not punctured during use. As such, the availability of hydration fluids is not compromised if the wearer takes a round to the front or rear armor plates 42 because the hydration bladder 44 is protected by the armor plate 42.

In addition, the hydration bladder 44 is conveniently disposed on the front of the soldier and easily accessible from the rear bottom opening 34 of the rear pouch 30 and the bottom opening 18 of the front portion 12 of the plate carrier 10. This is opposed to typical hydration bladders that may be disposed on or in the rear portion 46 of the plate carrier 10, where the hydration bladder may be more difficult to access and reconfigure without removing the plate carrier 10. This front-loaded configuration thus provides easy access to remove, refill, and re-insert the hydration bladder 44 during use, without the need to remove or reconfigure any other components of the armor system 20, including the armor plate 42. In this way, the soldier can maintain some level of protection during the removal and refilling of the hydration bladder 44.

Also, as noted above, accessing the hydration bladder 44 from the bottom opening 18 of the plate carrier 10 allows the soldier or other wearer to remove, refill, and re-insert the hydration bladder 44 without maneuvering the hydration bladder 44 around the soldier's chin, head, or other equipment secured to an upper portion of the plate carrier 10. In at least one embodiment, the hydration bladder 44 may hold up to or more than 8-liters of fluid. The amount of fluid may fluctuate within the inner volume 48 of the hydration bladder 44 as the soldier or other wearer consumes and replaces the hydration fluid during use.

Disposing the hydration bladder 44 in the front portion 12 of the plate carrier 10 also provides improved weight distribution between the front and back of the wearer. For example, typical hydration containers are carried on or in the rear portion 46 of the plate carrier 10 and may be bulky and rigid or uncomfortable to wear. Transferring the hydration bladder 44 to the front of the soldier or other wearer shifts weight to the front and better counterbalances the weight of equipment carried on or in the rear portion 46 without adding additional fluid weight.

Additionally, embodiments of the body armor system 20 described herein may be positioned on or in the rear portion 46 of the plate carrier 10 during use for added protection to the back of the soldier or other wearer. For example, FIG. 4 illustrates an armor system 21, shown in dotted lines, disposed within the rear portion 46. The armor system 21 disposed in the rear portion 46 may include all the same components as the armor system 20 disposed in the front portion 12. In such an embodiment, the wearer is protected from the back. In addition, carrying a hydration bladder 44 on the front and the back disperses the weight of hydration fluid more evenly between the front and back of the wearer.

Furthermore, including multiple hydration bladders 44 carried on both the front and rear portions 12, 46 of the plate carrier 10 increases the volume of fluid available for hydration and protection. In at least one embodiment, the armor system 20 is disposed only in the front portion 12 of the plate carrier 10. In at least one embodiment, the armor system 21 is disposed only in the rear portion 46. In at least one embodiment, the armor system 20, 21 includes two systems 20, 21 disposed in both the front and rear portions 12, 46 of the plate carrier 10, respectively.

Figure 5:
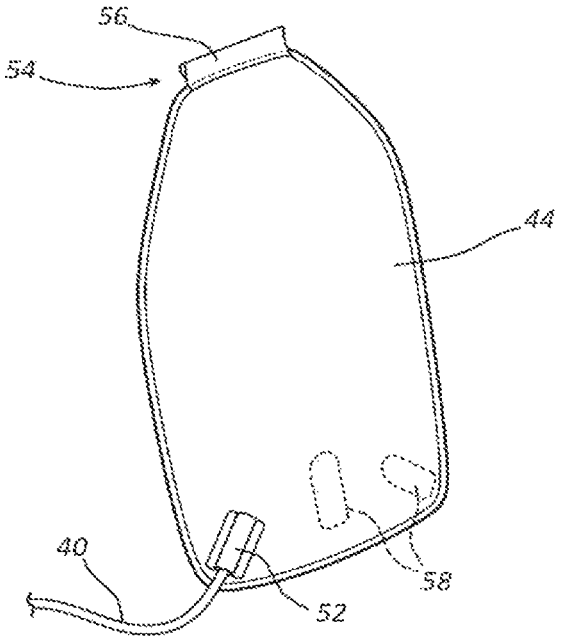
FIG. 5 illustrates an embodiment of a hydration bladder, according to the present disclosure.

FIG. 5 illustrates an embodiment of a hydration bladder 44 that includes a hose 40 extending from a port 52. The hydration bladder 44 also includes an opening 54 disposed at the top of the hydration bladder 44 with a closing mechanism 56 configured to selectively open and close the opening 54. In at least one embodiment, the opening 54 is disposed at the top of the hydration bladder 44 for easy access and convenient refilling of the hydration bladder 44. In at least one or more other embodiments, the opening 54 may be disposed elsewhere.

The port 52 may be angled to reduce kinking of the hose 40 as the hose extends downward and sideways through the rear bottom opening 34 of the rear pouch 30 as discussed above. In at least one embodiment, the angle and placement of the port 52 may vary to accommodate different shapes of hydration bladders 44. Preferably, the position and angle of the port 52 is such that most, if not all, of the fluid in the hydration bladder 44 is available for consumption and does not pool below the port 52 at the bottom of the hydration bladder 44. In addition, the position of the port is such that it is not exposed beyond the outer perimeter edges of the armor plate 42 during use. Thus, the location and angle of the port 52 may depend on the shape of the lower edge of the hydration bladder 44 and the orientation of the hose 40.

For example, FIG. 5 illustrates two other possible positions 58 of ports 52 that may be incorporated into the hydration bladder 44 in at least one or more other embodiments described herein. Furthermore, in at least one embodiment, the hydration bladder 44 includes more than one port 52 and respective hose 40 so that two, three, or more than three hoses 40 can provide access to fluid inside the hydration bladder 44. This may be advantageous when one port 52 and/or hose 40 fails. Multiple hoses 40 can also allow for multiple persons to share the fluid inside the hydration bladder 44 during operations in the field.

Additionally, at least one embodiment of the hydration bladder 44 includes an outer thermal layer or coating to maintain fluid temperature inside the hydration bladder 44, either hot or cold. In addition, such a thermal layer or coating can advantageously reduce the infrared signature of the body during combat operations, thus reducing the chance of visual identification of the soldier by the enemy.

Figure 6:
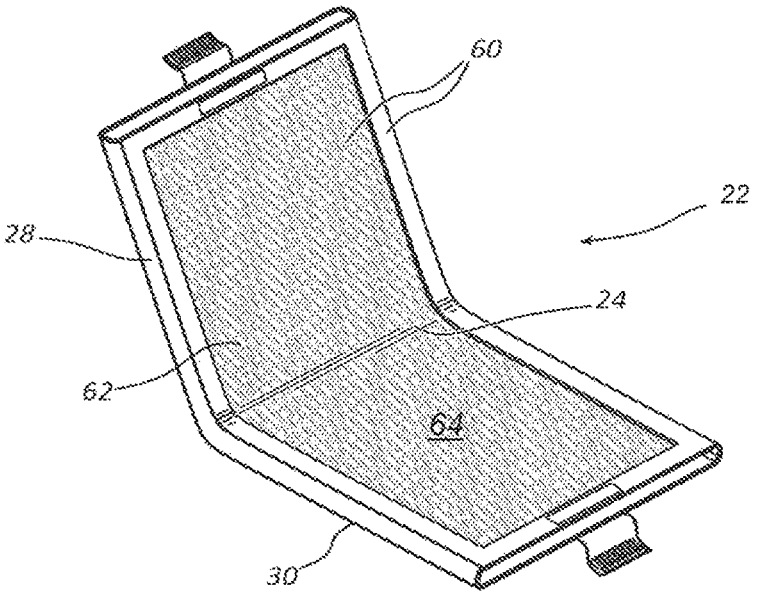
FIG. 6 illustrates an embodiment of a pouch assembly in an open configuration, according to the present disclosure.

FIG. 6 illustrates an embodiment of a pouch assembly 22 in an open configuration, showing the interior surfaces 60 thereof. The interior surfaces 60 of the pouch assembly 22 may include a window 62 comprising a transparent or semi-transparent material. Interior surface 60 of the pouch assemble 22 from an inner layer 64 configured to folded against itself in the closed configuration, see FIG. 2. In at least one embodiment, the window 62 may extend across the crease 24 from the front pouch 28 to the rear pouch 30. In at least one embodiment, the interior surfaces 60 may include more than one window portion 62, for example a separate window for each of the front and rear pouches 28, 30.

The transparent or semi-transparent material of the window 62 may comprise a netting material. In at least one embodiment, the window 60 may comprise a thin plastic or other transparent or semi-transparent material that is flexible to bend along the crease 24 as shown in FIG. 6.

Advantageously, the window 62 provides visual identification of the orientation and positioning of the armor plate 42 and hydration bladder 44 when inserted into the front and rear pouches 28, 30, respectively. Correct positioning and orientation of the armor plate 42 and hydration bladder 44 within the pouch assembly 22 is important because, for example, the armor plate 42 may have a strike face side, which is designed to face an oncoming bullet, and a body-toward side, which is designed to face the body of the wearer. As such, for optimal armor performance, the armor plate 42 must be correctly oriented within the pouch assembly.

Figure 7:
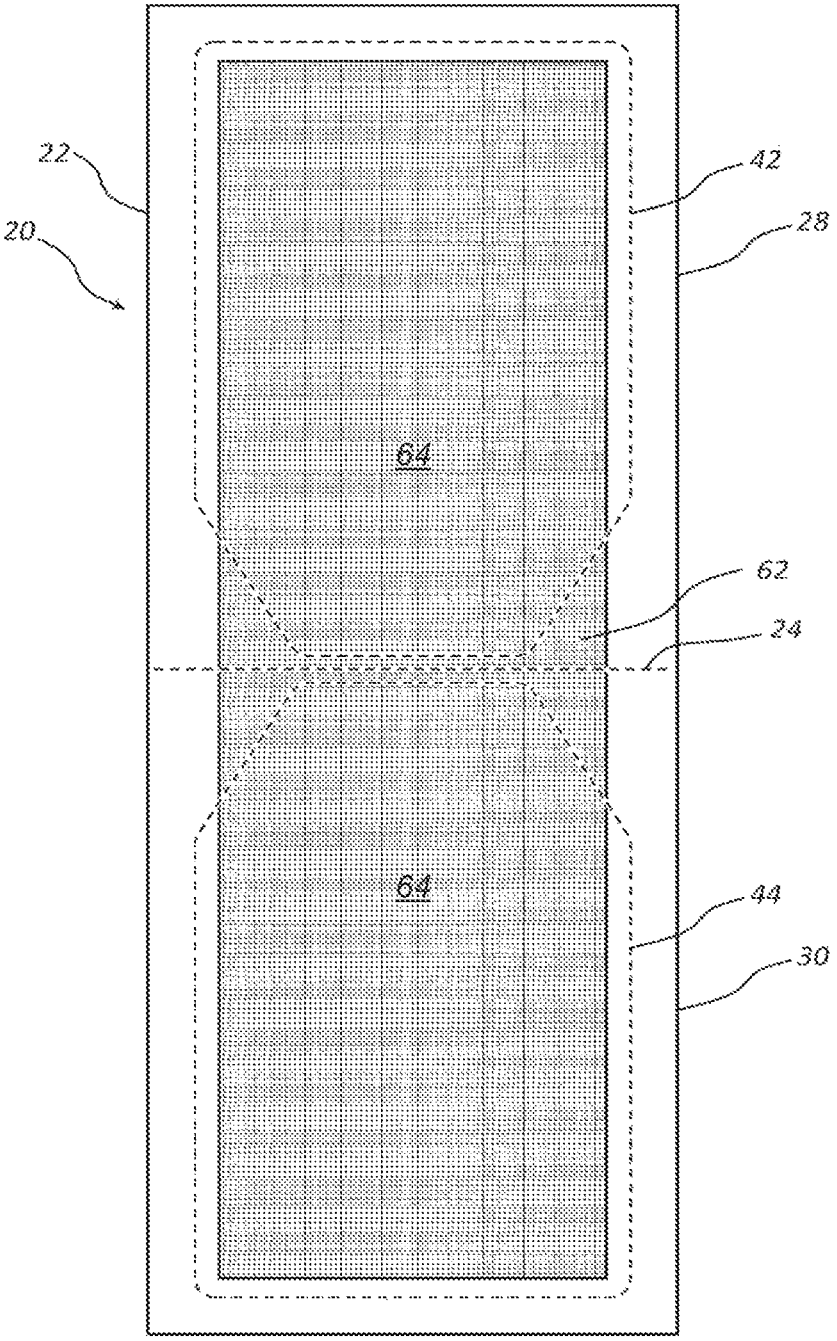
FIG. 7 illustrates an embodiment of a pouch assembly in an open configuration with dotted lines indicating a body armor plate and hydration bladder disposed within the pouch assembly, according to the present disclosure.

Also, the hydration bladder 44 is preferably inserted into the rear pouch 30 so that the shape of the hydration bladder 44, which compliments the shape of the armor plate 42, is properly aligned with the armor plate 42. For example, as shown in FIG. 7, the pouch assembly 22 is laid flat in an open configuration with front pouch 28 folded up and lying above the rear pouch 30 (as oriented in FIG. 7) and the window 62 facing upward toward the user. The armor plate 42, indicated in dotted lines, is disposed within the rear pouch 28. The hydration bladder 44, indicated in dotted lines, is disposed within the rear pouch 28.

As shown in FIG. 7, in at least one embodiment, the window 62 provides visibility into each of the front and rear pouches 28, 30 to visually confirm the correct alignment and position of the armor plate 42 and hydration bladder 44 before insertion of the armor system 20 within a plate carrier 10, as shown in FIGS. 1 and 4. For example, in at least one embodiment, the armor plate 42 includes one or more tags, stickers, colors, or other visual indicators of which side is the body-toward side. The armor plate 42 may also include one or more visual indications of which end is the upper end or lower end of the armor plate 42. After insertion into the front pouch 28 during assembly of the armor system 20, the user can see whether those visual indicators are facing the right directions or positioned correctly.

Likewise, in at least one embodiment, the hydration bladder 44 includes similar visual indicators to ensure proper alignment and positioning within the rear pouch 30. In addition, the shape of each of the hydration bladder 44 and/or armor plate 42 may be visible through the window 62 to check for proper positioning, orientation, and alignment within the pouch assembly 22.

As noted above, armor plates 42 typically used in the field include a variety of shapes and sizes. In one or more embodiments, the dimensions of the pouch assembly 22 may vary to accommodate the correct size and shape of armor plate 42 and/or hydration bladder 44 disposed therein. For example, the pouch assembly 22 may be dimensioned such that extra space within each of the front and rear pouches 28, 30 is minimized. In this way, jostling and shifting of the armor plate 42 and hydration bladder 44 is minimized during use, which may ensure, for example, proper alignment of the hydration bladder 44 behind the armor plate 42, and so forth.

In addition to the visual indicators noted above, in at least one embodiment, a color coding scheme may be employed to ensure that the correct size and shape of both the armor plate 42 and hydration bladder 44 are used with the appropriate pouch assembly 22. For example, a single color may be indicated on each of the hydration pouch 44, armor plate 42, and pouch assembly 22 for a certain sized swimmer plate and corresponding pouch assembly 22 and hydration bladder 44. As such, during assembly, the user may easily and quickly identify that all the correct components are being put together for optimal performance. Dissimilarly colored components can be easily identified and replaced with appropriately colored components.

In addition, in at least one embodiment, the window 62 comprises non-transparent material. In such an embodiment, other indicators may be included to ensure proper orientation and alignment of the hydration bladder 44 and armor plate 42 therein. For example, in at least one embodiment where the window 62 is not transparent, the hydration bladder 44 and/or armor plate 42 may include labels or other icons indicating proper alignment, orientation, and differentiation between sides and faces of the components being inserted into the pouch assembly 22.

Also, as indicated by the dotted line showing the crease 24 in FIG. 7, a visual indicator, such as those noted above, may also identify a central line where the crease 24 ought to be formed during assembly. For example, the crease 24 indication may inform the assembler how far to insert either the hydration bladder 44 or armor plate 42 into respective pouches 28, 30 so that folding the pouch assembly 22 after insertion forms two equally sized pouches 28, 30. In this way, the hydration bladder 44 and armor plate 42 do not extend out the bottom of their respective pouches 28, 30 during use.

The foregoing visual indications and window features of the armor system 20 are advantageous in the field, where frequent and thorough equipment checks must be performed quickly and precisely to ensure proper equipment functionality and safety.

Figure 8:
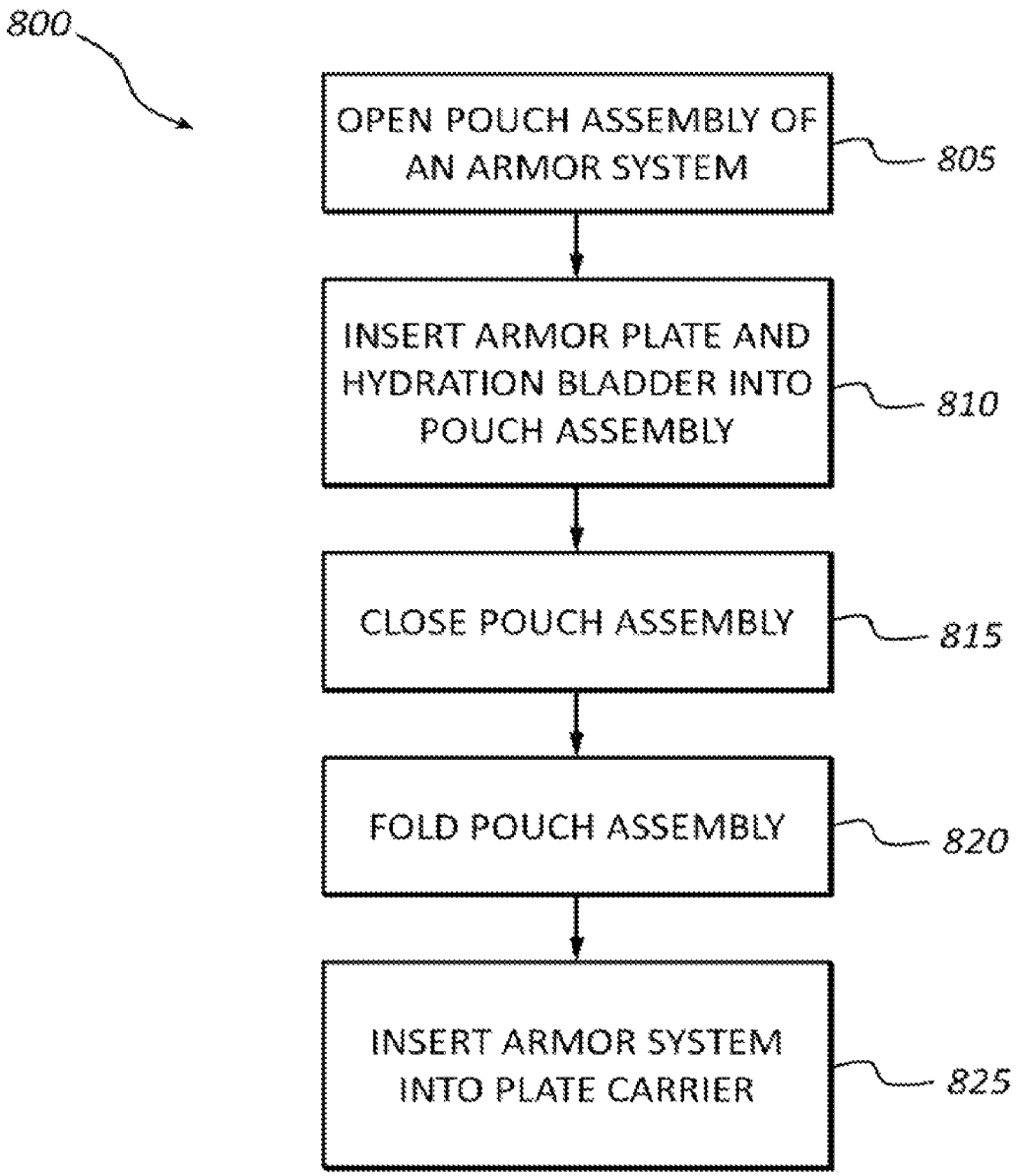
FIG. 8 illustrates an embodiment of a method of assembling a body armor system, according to the present disclosure.

FIG. 8 illustrates an embodiment of a method 800 of assembling a body armor system 20, according to the present disclosure. In a first step 805, the method includes opening a pouch assembly of an armor system. For example, FIGS. 2, 3, 6, and 7 depict a pouch assembly 22 in various open and closed configurations, including open and closed bottom openings 32, 34 of front and rear pouches 28, 30, respectively, as described herein.

A second step 810 of the method 800 includes inserting an armor plate and hydration bladder into the pouch assembly. For example, FIG. 3 illustrates an embodiment of an armor plate 42 and hydration bladder 44 being inserted into an open pouch assembly 22, as indicated by the dotted arrows, as described herein. Also, FIG. 7 illustrates an embodiment of an armor plate 42 and hydration bladder 44 inserted into an open pouch assembly 22, as described herein.

A third step 815 of the method 800 includes closing the pouch assembly. This step 815 is depicted, for example, at least in FIGS. 2 and 4, which show closing mechanisms 38 that close the front and rear bottom openings 32, 34 of the front and rear pouches 28, 30, respectively, as described herein.

A fourth step 820 of the method 800 includes folding the pouch assembly. For example, at least FIGS. 2, 3, 4, and 6 depict an embodiment of a pouch assembly 22 folded in various degrees along the crease 24, as described herein.

A fifth step 825 of the method 800 includes inserting the armor system into a plate carrier. For example, FIGS. 1 and 4 depict an embodiment of an armor assembly 20 inserted into the front portion 12 of a plate carrier 10, as described herein.

In at least one or more embodiments, the method 800 may also include other steps, including, for example, inserting one or more trauma pads into the pouch assembly or plate carrier, as described herein. Also, for example, at least one embodiment of the method 800 includes a step of applying or inserting a spall-absorbing material, such as PAXCON or other spall-absorbing material, on or in front of the front pouch of the pouch assembly, as described herein. In at least one embodiment, the PAXCON or other spall-absorbing material can also be applied to the rear pouch of a pouch assembly.

Also, for example, at least one embodiment of the method 800 includes filling an inner volume of the hydration bladder with hydration fluid, such as water, as described herein, before inserting the hydration bladder into the pouch assembly in the second step 810.

Also, for example, at least one embodiment of the method 800 includes as step of ensuring proper alignment and positioning of the armor plate and hydration bladder within the pouch assembly. For example, this step is depicted in FIG. 7 and described in the corresponding description above.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A body armor system, comprising:

a foldable dual pouch having a rectangular shape in planar unfolded view, comprising:

an inner layer comprising a window of a transparent or semi-transparent material allowing a user to view the contents behind the window;

an outer layer connected to the inner layer along left and right edges of the foldable dual pouch;

a crease disposed mid-section of the foldable dual pouch running between the left and the right edges, the inner layer configured to be folded against itself along the crease to form a folded dual pouch;

a front pouch extending from the crease and disposed between the inner and the outer layers, the front pouch further comprising a front opening along a front edge opposite the crease;

a rear pouch extending from the crease and disposed between the inner and the outer layers, the rear pouch further comprising a rear opening along a rear edge opposite the crease;

an armor plate disposed within the front pouch; and a hydration bladder disposed within the rear pouch.

2. The body armor system according to claim 1, wherein the folded dual pouch with armor plate in front of the hydration bladder is configured to be inserted into a body armor plate carrier within a cavity configured for receiving an armor plate, such that when the carrier is worn by a user, the hydration bladder is between the user and the armor plate.

3. The body armor system according to claim 1, wherein:

a shape of the hydration bladder corresponds to a shape of the armor plate; and the hydration bladder is dimensioned so as to be hidden behind the armor plate during use.

4. The body armor system according to claim 1, wherein, the hydration bladder further comprising a hose extending from a port, the hose providing access to fluid disposed within the hydration bladder during use.

5. The body armor system according to claim 1, wherein the outer layer of the front pouch further comprises a spall-absorbing layer disposed thereon.

6. The body armor system according to claim 1, further comprising a body armor plate carrier having a front portion with a cavity having a bottom opening to access the cavity, the cavity configured for receiving the foldable dual pouch into the cavity through the bottom opening in the front portion.

7. The body armor system according to claim 1, wherein a shape of the hydration bladder corresponds to a shape of a swimmer armor plate.

8. The body armor system according to claim 1, wherein a shape of the hydration bladder corresponds to a square armor plate.

9. The body armor system according to claim 1, wherein a shape of the hydration bladder corresponds to a shape of an advanced shooter's cut armor plate shape.

10. A body armor kit, comprising:

a foldable dual pouch having a rectangular shape in planar unfolded view, the foldable dual pouch comprising:

an inner layer comprising a window of a transparent or semi-transparent material configured to allow a user to view the contents behind the window;

an outer layer connected to the inner layer along left and right edges of the foldable dual pouch;

a crease disposed mid-section of the foldable dual pouch running between the left and the right edges, the inner layer configured to be folded against itself along the crease to form a folded dual pouch;

a front pouch extending from the crease, the front pouch further comprising a front opening along a front edge;

a rear pouch extending from the crease, the rear pouch further comprising a rear opening along a rear edge;

an armor plate disposed within the front pouch; and a hydration bladder disposed within the rear pouch.

11. The kit according to claim 10, wherein the folded dual pouch with armor plate in front of the hydration bladder is configured to be inserted into a body armor plate carrier within a cavity configured for receiving an armor plate, such that when the carrier is worn by a user, the hydration bladder is between the user and the armor plate.

12. The kit according to claim 10, wherein:

a shape of the hydration bladder corresponds to a shape of the armor plate; and the hydration bladder is dimensioned so as to be hidden behind the armor plate during use.

13. The kit according to claim 10, wherein, the hydration bladder further comprising a hose extending from a port, the hose providing access to fluid disposed within the hydration bladder during use.

14. The kit according to claim 10, wherein the outer layer of the front pouch further comprises a spall-absorbing layer disposed thereon.

15. The kit according to claim 10, wherein a shape of the hydration bladder corresponds to an armor plate shape selected from the group consisting of: swimmer's cut, square and advanced shooter's cut.

16. The kit according to claim 10, wherein the hydration bladder further comprises a thermal layer configured to reduce an infrared signature of a wearer during use.

17. The kit according to claim 10, wherein the front pouch and the rear pouch are mirror images of each other about the seam.

* * * * *